US006467795B1

(12) United States Patent
Hirayama et al.

(10) Patent No.: US 6,467,795 B1
(45) Date of Patent: Oct. 22, 2002

(54) SNOWBOARD BINDING WITH HIGHBACK

(75) Inventors: Syuichi Hirayama, Osaka (JP); Toshiyuki Tanaka, Osaka (JP)

(73) Assignee: Shimano Inc., Osaka (JP)

( * ) Notice: Subject to any disclaimer, the term of this patent is extended or adjusted under 35 U.S.C. 154(b) by 0 days.

(21) Appl. No.: 09/750,016

(22) Filed: Dec. 29, 2000

(51) Int. Cl.[7] ..... A63C 9/08

(52) U.S. Cl. ..... 280/613; 280/618; 280/14.24; 36/117.3

(58) Field of Search ..... 280/613, 617, 280/618, 623, 626, 633, 634, 14.21, 14.22, 14.24; 369/115, 117.1, 117.3

(56) References Cited

U.S. PATENT DOCUMENTS

| | | | | |
|---|---|---|---|---|
| 5,356,170 A | | 10/1994 | Carpenter et al. | |
| 5,722,680 A | | 3/1998 | Dodge | |
| 5,845,421 A | | 12/1998 | Tanaka | |
| 5,853,188 A | | 12/1998 | Alden | |
| 5,890,730 A | | 4/1999 | Anderson et al. | |
| 6,099,018 A | | 8/2000 | Maravetz et al. | |
| 6,120,038 A | * | 9/2000 | Dong et al. | 280/613 |
| 6,123,354 A | | 9/2000 | Laughlin et al. | |
| 6,164,682 A | | 12/2000 | Okajima et al. | |
| 6,213,403 B1 | * | 4/2001 | Korman | 280/613 |

FOREIGN PATENT DOCUMENTS

| | | |
|---|---|---|
| EP | 0 553 934 A1 | 8/1993 |
| EP | 0 898 990 A1 | 3/1999 |
| EP | 0 934 762 A1 | 8/1999 |
| EP | 0 966 994 A2 | 12/1999 |
| JP | 8-308977 A | 11/1996 |
| JP | 10-127853 A | 5/1998 |
| JP | 11-57110 A | 3/1999 |
| JP | 11-342236 A | 12/1999 |
| WO | WO 97/22390 A1 | 6/1997 |
| WO | WO 98/07479 A1 | 2/1998 |

OTHER PUBLICATIONS

Technologies, Step–in System: SIS; Catalog page, Published Prior to Dec. 29, 2000.

* cited by examiner

*Primary Examiner*—Michael Mar
(74) *Attorney, Agent, or Firm*—Shinjyu Global IP Counselors, LLP

(57) ABSTRACT

A snowboard binding is provided that is relatively easy to step-in and step-out of. The snowboard binding preferably has a highback that provides a tight fit between a soft boot and the highback. The snowboard binding has a base plate, a first binding member and a second binding member. The first binding member is coupled to one of the front and rear portions of the base plate. The second binding member is coupled to the other of the front and rear portions of the base plate. The second binding member is coupled to the base plate at a location that is longitudinally spaced from the first binding member. The second binding member includes a catch member movably relative to the base plate and a latch member movable movably relative to the base plate. The latch member is arranged to selectively hold the catch member in a plurality of engagement positions having different heights above the base plate.

30 Claims, 13 Drawing Sheets

SNOWBOARD BINDING WITH HIGHBACK

BACKGROUND OF THE INVENTION

This invention generally relates to a snowboard binding with a highback support. More specifically, the present invention relates to a snowboard binding with a highback support that is easily to step-in and step-out of.

BACKGROUND INFORMATION

In recent years, snowboarding has become a very popular winter sport. In fact, snowboarding was also an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt accordingly turning in the direction of the lean. Similarly, leaning forward causes the board to tilt in a corresponding manner and thus causing the snowboard to turn in that direction.

Generally, the sport may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots, or adaptations of such boots as distinct from hard shell alpine boots are typically worn, fitted into so-called soft bindings.

Boots that are used for, for instance, skiing and/or snowboarding must have a high degree of rigidity for effecting steering while skiing and snowboarding. In particular, when snowboarding it is important that the rider be able to lean to the side, back and forward with respect to the snowboard. The motion corresponding to the direction of the lean of the rider is transmitted through the boots to the snowboard (or skis) to effect turning or braking. Therefore, it is extremely important that the boots worn by the rider have sufficient rigidity to transfer such leaning motion to the snowboard or skis.

In particular, the back side of a snowboard boot must be rigid in order to provide the appropriate support for controlling movement of the snowboard. Further, as the art of snowboarding has developed, riders have found that snowboard boots provide optimal support when the back side of the snowboard boots are inclined slightly, such that the knees of the rider are always slightly bent when wearing the boots on level ground. Therefore, standing up straight with knees straight when wearing inclined snowboard boots is not always comfortable. Further, walking in such snowboard boots is sometimes awkward.

Recently, snowboard boots have been developed which allow a rider to adjust and change the inclination of inclined backside snowboard boots. For example, there are snowboard boots which include a member known as a highback support that is secured to the snowboard boot by pins which allow the highback support to pivot about the pins. The highback support extends up the back side of the boot and when locked into position fixes the back side of the boot into a predetermined inclined position that is optimal for snowboarding. When unlocked, the highback support can pivot back and allow the rider wearing the boot to stand up straight and walk more freely without having to keep the knees bent. A simple bar is used with such a boot for locking the highback support in place. Typically, the bar braces the highback support into position. An upper end of the bar is fixed to an upper portion of the highback support by a pivot pin. A lower end of the bar is configured to fit into a hook formed in a lower portion of the boot. When a rider is wearing the boots, the rider must lean forward in order to fit the bar into and out of position. The lean forward requires a significant amount of effort due to the overall rigidity of the snowboard boots and therefore the bar configuration, especially in the snow and cold, can be difficult for some riders to release and/or engage.

Accordingly, a snowboarder may want to change the binding orientation depending on the style of snowboarding, snowboarder level of skill and/or rider preferences. Moreover, snowboarders typically ride with their left foot in front of the right foot on the snowboard. However, some snowboarders want to ride with their right foot in front of the left foot on the snowboard (so-called goofy style). In order to accommodate the different styles of snowboarding, the snowboarder level of skill and/or the snowboarder preferences, the bindings have been made to be adjustable so that the snowboarder can adjust the angle of his feet relative to the longitudinal axis of the snowboard. In the past, changing the angle of the snowboarder's stance required the snowboarder to loosen several mounting screws so that the binding may be rotated relative to the snowboard, and then re-tightening the screws. This type of binding is very time consuming in order to change the snowboarder's stance. Moreover, a tool must be used to adjust the snowboarder's stance.

In view of the above, there exists a need for a snowboard binding which overcomes the above mentioned problems in the prior art. This invention addresses this need in the prior art as well as other needs, which will become apparent to those skilled in the art from this disclosure.

SUMMARY OF THE INVENTION

One object of the present invention is to provide a snowboard binding that is relatively easy to step-in and step-out of.

Another object of the present invention is to provide a snowboard binding with a highback that provides a tight fit between a soft boot and the highback.

Another object of the present invention is to provide a snowboard binding adjustment mechanism that is relatively simple and inexpensive to manufacture.

Another object of the present invention is to provide a snowboard binding adjustment mechanism that is relatively lightweight.

In accordance with one aspect of the present invention, a snowboard binding is provided with a highback. The snowboard binding includes a snowboard binding, comprising a base plate, a first binding member and a second binding member. The base plate has a front portion, a rear portion and a longitudinal axis extending between the front and rear portions. The first binding member is coupled to the base plate. The second binding member is coupled to the base plate at a location that is longitudinally spaced from the first binding member. The second binding member includes a catch member and a latch member. The catch member is movable relative to the base plate. The latch member is movable relative to the base plate. The latch member is arranged to selectively hold the catch member in a plurality of engagement positions having different heights above the base plate.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
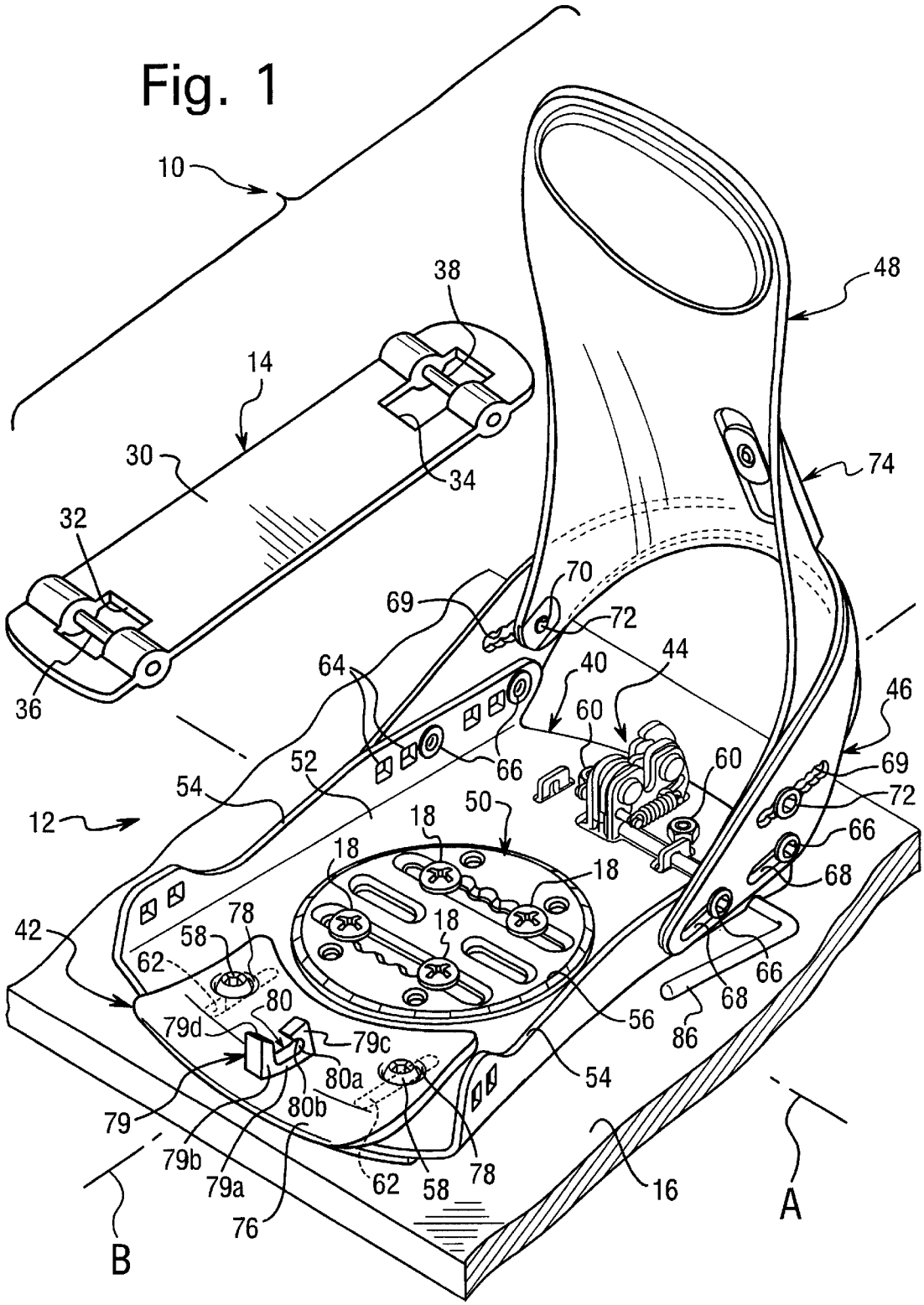
FIG. 1 is a perspective view of a snowboard binding system having a snowboard binding fixed to a snowboard and a boot attachment member.

Referring initially to FIG. 1, a snowboard binding system 10 is illustrated in accordance with a first embodiment of the present invention. The snowboard binding system 10 basically includes a snowboard binding 12 and an attachment member 14. The snowboard binding 12 is attached to the top or upper surface of the snowboard 16 via four fasteners or screws 18 in a conventional manner. The longitudinal axis of the snowboard 16 is represented by centerline A in FIG. 1. It will be apparent to those skilled in the art from this disclosure that a pair of snowboard binding systems 10 are utilized in conjunction with snowboard 16 such that the rider has both feet firmly attached to the snowboard 16. For the sake of brevity, only a single snowboard binding system 10 will be discussed and/or illustrated herein.

Figure 2:
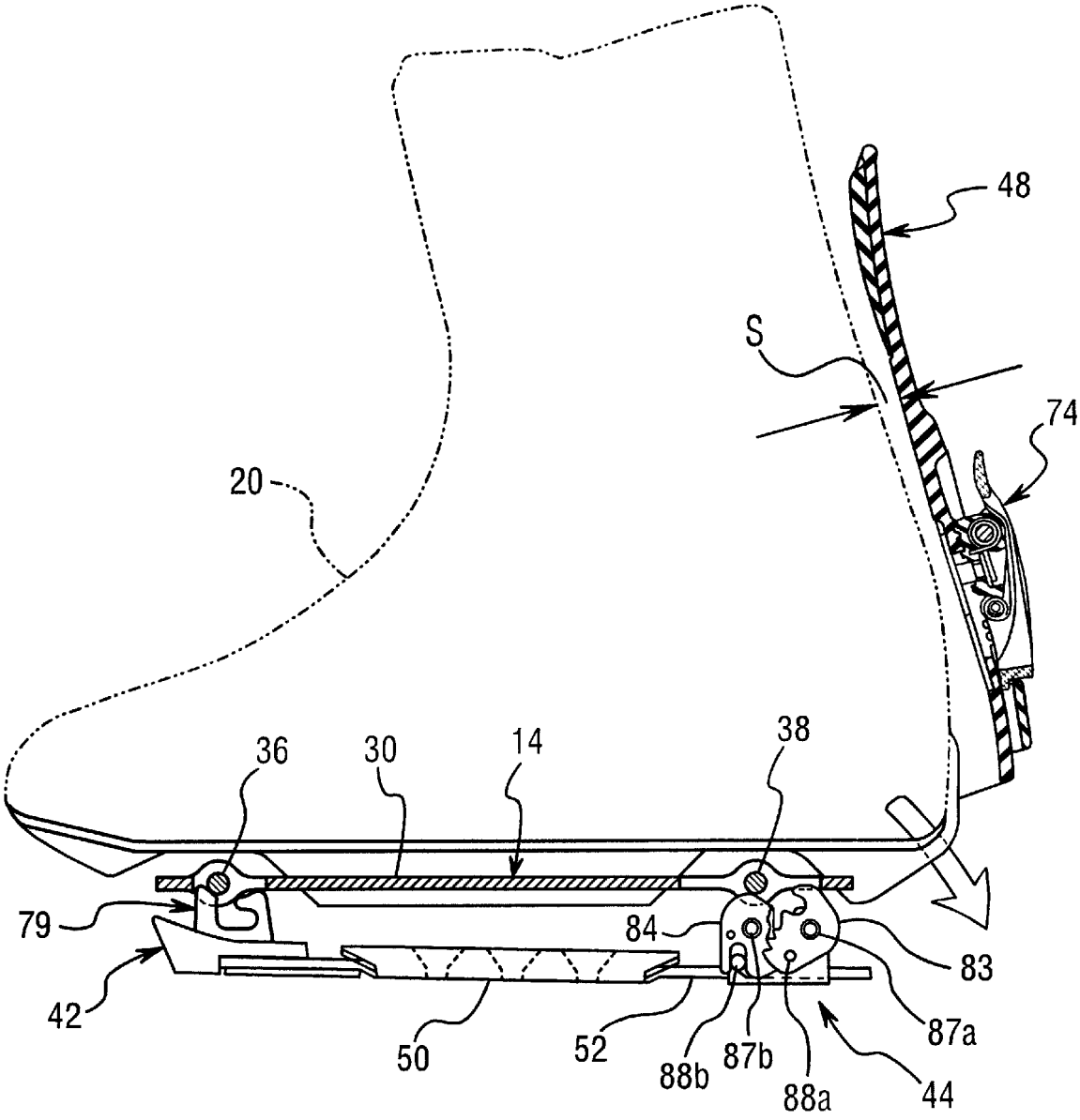
FIG. 2 is a diagrammatic cross-sectional view of the snowboard binding system illustrated in FIG. 1 with the snowboard boot being illustrated just prior to engagement of the attachment member to the snowboard binding.
Figure 3:
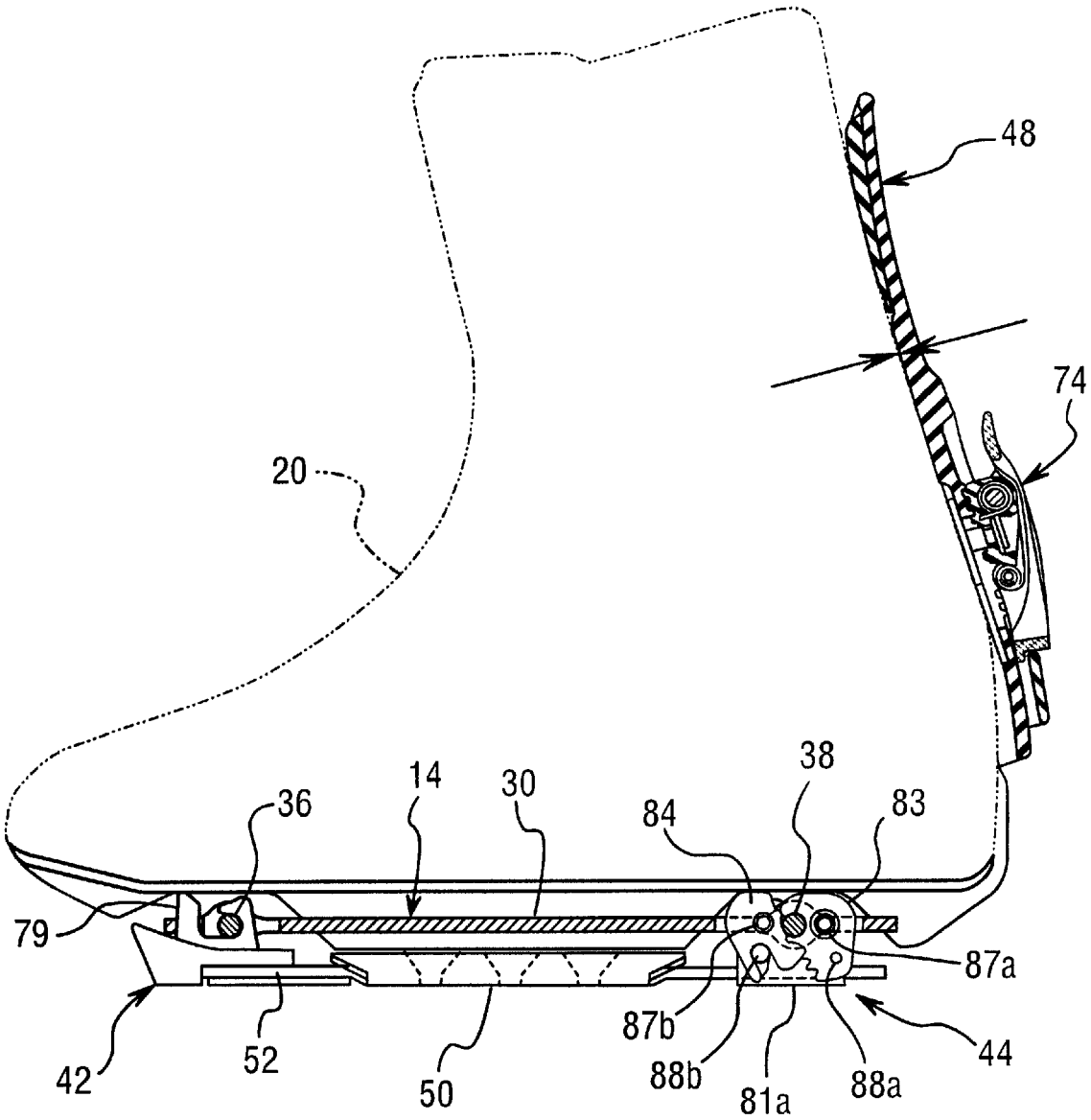
FIG. 3 is a diagrammatic cross-sectional view of the snowboard binding system illustrated in FIGS. 1 and 2 with the attachment member of the snowboard boot being fully engaged with the snowboard binding.

The attachment member 14 is fixedly coupled to the bottom or sole of the snowboard boot 20 as seen in FIGS. 2 and 3. More specifically, the snowboard attachment member 14 is preferably either molded into the sole of the snowboard boot 20 or attached thereto via fasteners (not shown). Referring again to FIG. 1, the attachment member 14 basically has a body portion 30 with front and rear openings 32 and 34. Front and rear attachment pins 36 and 38 are coupled to the body portion 30 so as to cross openings 32 and 34. As should be appreciated from this disclosure, the present invention is not limited to the precise construction of attachment member 14. Rather, the attachment member 14 can be implemented in any number of ways, and the present invention is not limited to the particular implementations shown in the drawings, which are provided merely for purposes of illustration.

Snowboard boot 20 is only diagrammatically illustrated herein, since the precise construction is not relevant to the present invention. Preferably, the present invention is utilized with a soft or flexible snowboard boot. Soft snowboard boots are well known in the art, and thus, will not be discussed or illustrated herein. Basically, soft snowboard boots have a sole portion made of a stiff rubber-like material, and a flexible upper portion constructed of a variety of materials, such as plastic materials, leather and/or synthetic leather materials. Thus, the upper portion of a soft snowboard boot should be somewhat flexible.

Still referring to FIG. 1, the snowboard binding 12 is preferably a highback binding that applies a forward leaning force on the snowboard boot 20. The snowboard boot binding 12 basically includes a base plate 40, a front binding member 42, a rear binding member 44, a heel cup 46 and a highback 48. The snowboard binding 12 is preferably adjustably coupled to snowboard 16 via an adjustment disk 50.

The adjustment disk 50 is attached to the snowboard 16 via fasteners or screws 18 that clamp the base plate 40 to the top surface of the snowboard 16. Accordingly, base plate 40 is angularly adjustable relative to the adjustment disk 50 and the snowboard 16 by loosening the fasteners or screws 18. Of course, the base plate 40 could be attached directly to the snowboard 16, as needed and/or desired. It should be appreciated by those skilled in the art from this disclosure that the attachment of base plate 40 to the snowboard 16 can be accomplished in a number of ways. Moreover, the present invention is not limited to any particular implementation.

As seen in FIG. 1, the base plate 40 preferably has a mounting portion 52 and a pair of side attachments 54. Preferably, the base plate 40 is constructed of a hard, rigid material. Examples of suitable hard rigid materials for the base plate 40 include various metals as well as carbon and/or a metal/carbon combination. In the preferred embodiment, the mounting portion 52 and the side attachment 54 are formed by bending a metal sheet material. Thus, base plate 40 is a one-piece, unitary member. The mounting portion 52 has a central opening 56 for receiving adjustment disk 50 therein. Preferably, the opening 56 has a beveled edge that is serrated to form teeth for engaging a corresponding bevel edge with mating teeth of the adjustment disk 50.

Also, the front and rear binding members 42 and 44 are fixedly coupled to the mounting portion 52 of the base plate 40. More specifically, the front binding member 42 is fastened to a front portion of the mounting portion 52 via a pair of fasteners 58. The front binding member 42 is attached to the rear portion of the mounting portion 52 of base plate 40 via a pair of fasteners 60. Preferably, the fasteners 58 and 60 are a nut and bolt type of arrangement. Of course, it will be apparent to those skilled in the art from this disclosure that other types of arrangements are possible.

Preferably, the front binding member 42 is adjustably coupled by mounting slots 62 formed in mounting portion 52. In other words, the front binding member 42 can be adjusted in a longitudinal direction. More specifically, the front member 42 is adjustable along the longitudinal axis B of the mounting portion 52 of the base plate 40.

As seen in FIG. 1, each of the side attachments 54 of the base plate 40 preferably includes a plurality of attachment holes 64 for adjustably attaching the heel cup 46 thereto via fasteners 66. Preferably, the fasteners 66 are nuts and bolts that are used to adjustably couple the heel cup 46 in the attachment holes 64.

The heel cup 46 is preferably constructed of a hard rigid material. Examples of suitable hard rigid materials for heel cup 46 include various metals, as well as carbon and/or a metal/carbon combination. The heel cup 46 is an arcuate member having a pair of slots 68 at each of the lower free ends that are attached to the side attachments 54 of the base plate 40. The slots 68 receive fasteners 66 therein to adjustably couple the heel cup 46 to the base plate 40. Additional slots 69 are provided in the heel cup 46 to attach the highback 48 to the heel cup 46. Accordingly, the heel cup 46 is adjustably coupled to each of the side attachments 54 of base plate 40 and the highback 48 is adjustably coupled to the heel cup 46.

Highback 48 is a rigid member constructed of a hard rigid material. Examples of suitable hard rigid materials for highback 48 include a hard rigid plastic material or various composite types of materials. Of course, the highback 46 could also be constructed of various metals. The highback 48 has a substantially U-shaped bottom portion with a pair of holes 70 for receiving fasteners 72. Fasteners 72 are adjustably coupled within slots 69 of the heel cup 46 to allow adjustment of the highback about a vertical axis. The highback 48 is pivotally coupled to the heel cup 46 by the fasteners 72. The highback 48 also preferably has a conventional forward lean adjuster 74 that engages the heel cup 46 to cause the highback 48 to lean forward relative to the base plate 40. The precise construction of the forward lean adjuster 74 is not relevant to the present invention. Moreover, the forward lean adjuster 74 illustrated in FIGS. 1–3 is well known in the art, and thus, will not be discussed or illustrated herein. Of course, it will be apparent to those skilled in the art from this disclosure that the forward lean adjustment can be implemented in any number of ways, and that the present invention should not be limited to any particular implementation of the forward lean adjustment.

The front binding member 42 basically includes a plate member 76 with a pair of mounting holes 78 and an engagement member 79 in the form of a cleat or hook. The plate member 76 is preferably wedge shaped such that its upper surface slopes upwardly as it approaches the front of the base plate 40. This upward inclination of the plate member 76 allows for easy attachment of the boot 20 and better edging. The engagement member 79 has a substantially C-shape that forms an attachment slot 80. The attachment slot 80 has a longitudinal length of at least about 6.6 millimeters to allow the boot 20 to flex forwardly during attachment of the boot 20 to the binding 12. In other words, the longitudinal length of the attachment slot 80 should be greater than the distance "S" between the rear of the boot 20 and the highback 48 so that the boot 20 to flex forwardly during attachment of the boot 20 to the binding 12. The engagement member 79 has an attachment portion **79*a* fixed to the plate member 76, a guide portion 79*b* extending upwardly form the front of the attachment portion 79*a* and a retaining portion 79*c* extending upwardly form the rear of the attachment portion 79*a*. The upper end of the guide portion 79*c* forms a guide surface 79*d* for guiding the front attachment pin 36 into the attachment slot 80. The attachment slot 80 has a forwardly facing engagement or stop surface 80a and a downwardly facing engagement or retaining surface 80*b* to hold the front attachment pin 36 therein when the rear attachment pin 38 is coupled to the rear binding 44**, as discussed below.

It will be apparent to those skilled in the disclosure that the illustrated embodiment of the front binding member 42 can be implemented in a number of ways, and that the present invention is not necessarily limited to any particular implementation. In any event, the attachment slot 80 preferably extends substantially parallel to the longitudinal axis B of the base plate 40. The stop surface **80*a* faces towards the front portion of the base plate 40, while the retaining surface 80*b* is spaced above the top surface of the base plate 40 and faces towards the top surface of the base plate 40**.

Figure 4:
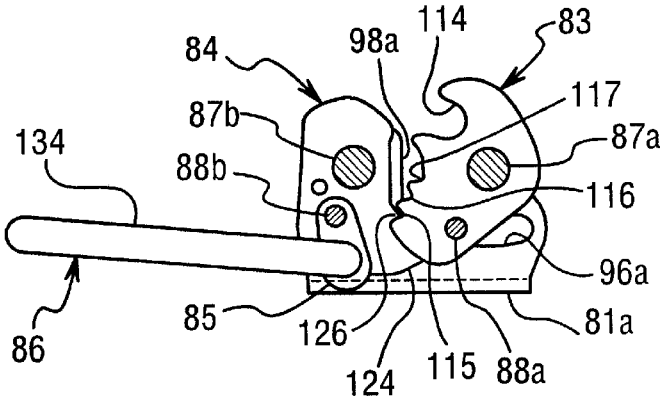
FIG. 4 is a side elevational view of the rear binding member with certain portions broken away for purposes of illustration to illustrate the release position.
Figure 5:
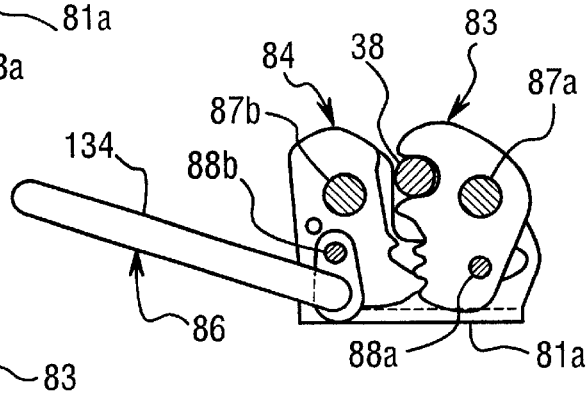
FIG. 5 is a side elevational view of the rear binding member with certain portions broken away to illustrate engagement with the rear attachment pin in the first engagement position.
Figure 6:
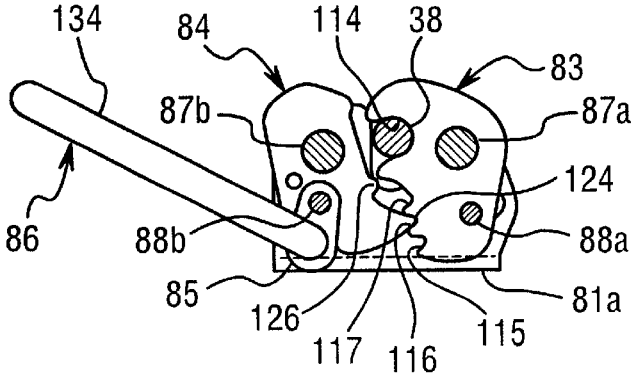
FIG. 6 is a side elevational view of the rear binding member illustrated in FIGS. 1–5 with certain portions broken away to illustrate the rear attachment pin engaged with the rear binding member in the second engagement position.
Figure 7:
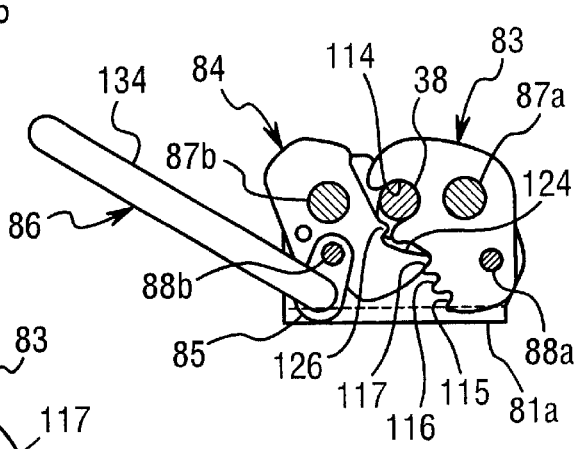
FIG. 7 is a side elevational view of the rear binding member illustrated in FIGS. 1–6 with certain portions broken away to illustrate the rear attachment pin engaged with the rear binding member in the third engagement position.
Figure 8:
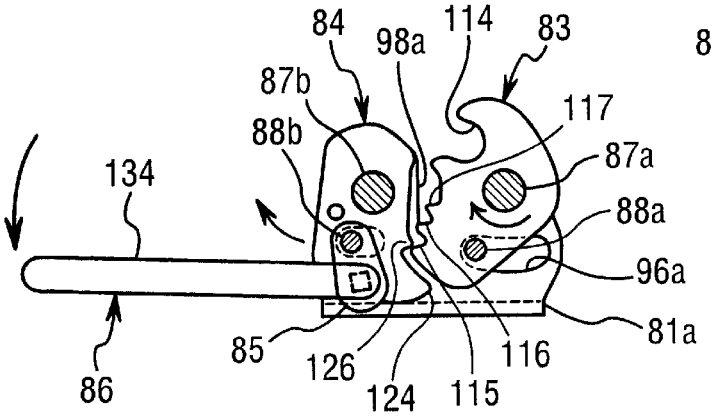
FIG. 8 is a side elevational view of the rear binding member illustrated in FIGS. 1–7 with certain portions broken away to illustrate release of the rear attachment pin.
Figure 9:
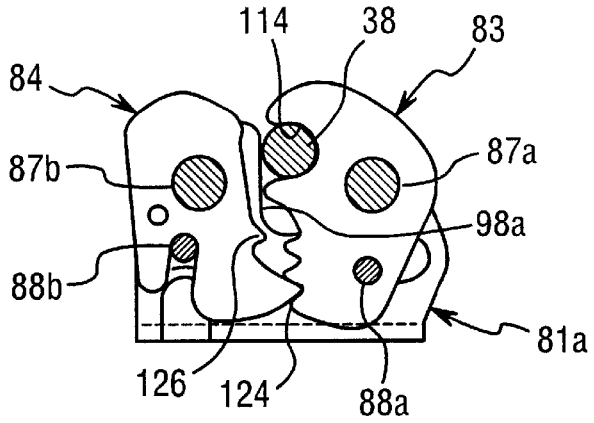
FIG. 9 is a cross-sectional view of the rear binding member coupled to the rear attachment pin in the first engagement position.
Figure 10:
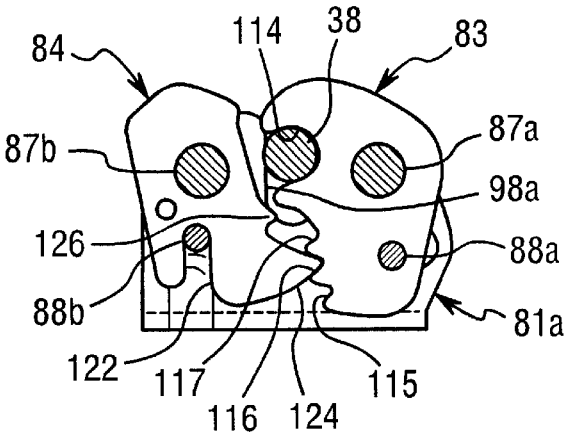
FIG. 10 is a cross-sectional view of the rear binding member illustrated in FIGS. 1–9 with the rear binding member in the second engagement position.
Figure 11:
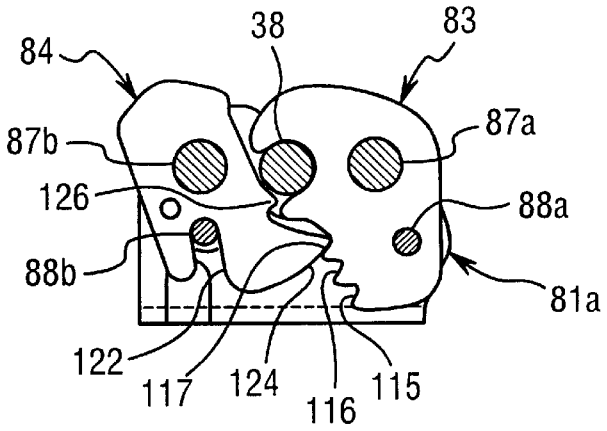
FIG. 11 is a cross-sectional view of the rear binding member illustrated in FIGS. 1–10 with the rear binding member in the third attachment position.
Figure 12:
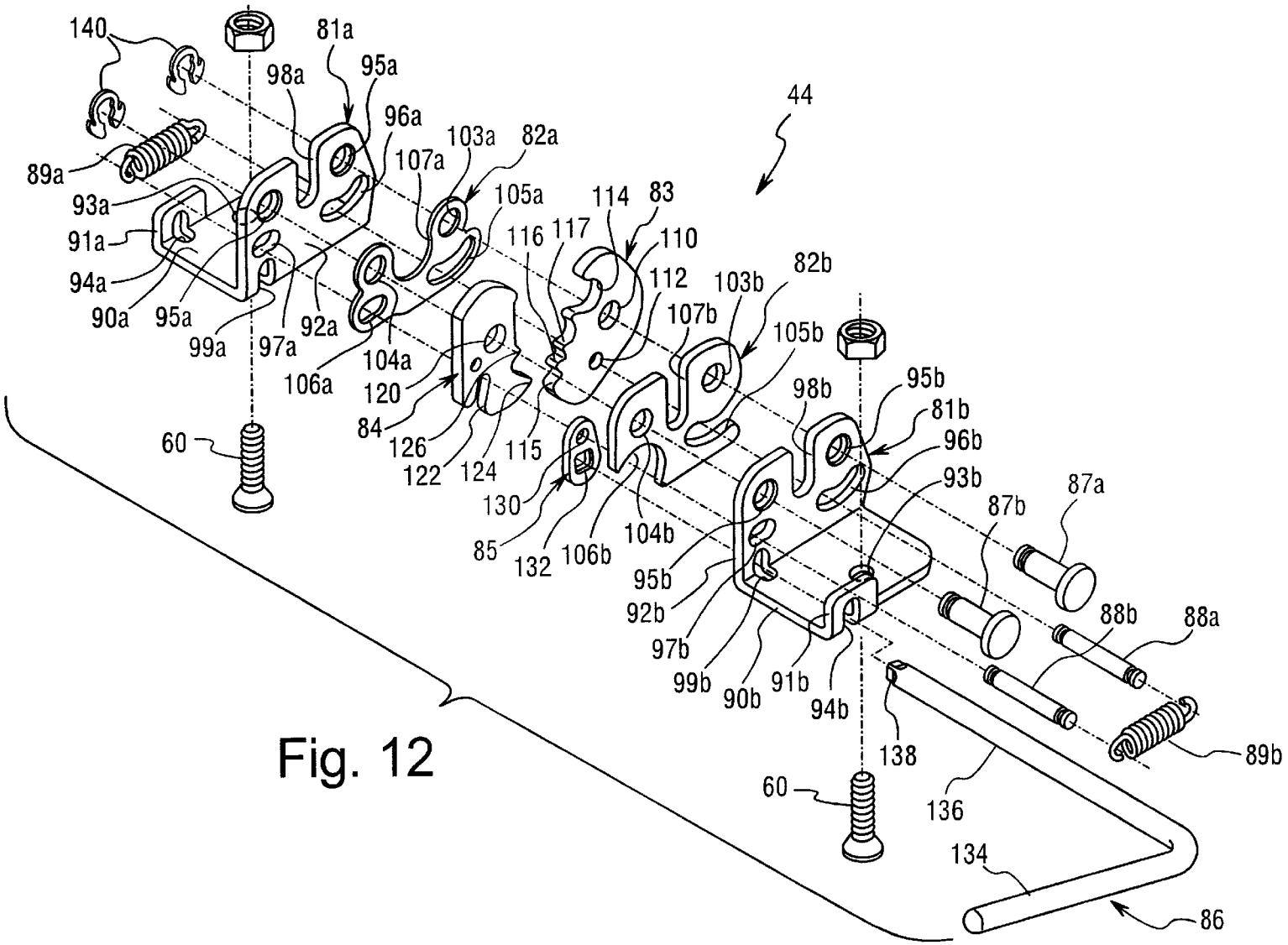
FIG. 12 is an exploded perspective view of the rear binding member illustrated in FIGS. 1–11.

Referring now to FIG. 12, the various parts of the rear binding member 44 are illustrated. Basically, the rear binding member 44 includes a pair of mounting members **81*a*** and 81*b,* a pair of spacers 82*a* and 82*b,* a catch plate 83, a latch plate 84, a control link 85, a control lever 86, a pair of pivot pins 87*a* and 87*b,* a pair of control pins 88*a* and 88*b,* and a pair of biasing members 89*a* and 89*b.* The rear binding member 44 has a release position, as seen in FIGS. 2 and 4, and three locking or engagement positions, as seen in FIGS. 9–11. This arrangement of the rear binding member 44 allows sole of the snowboard boot 20 to be mounted at three different heights (17 mm, 19 mm and 21 mm) above the top surface of the base plate 40. In other words, the rear binding member 44 can accommodate an accumulation of snow on the upper surface of the base plate 40, or on the bottom of the snowboard boot 20.

First and second mounting members 81*a* and 81*b* are preferably rigid support brackets that are fixedly secured to the base plate 40 via fasteners 60. The first mounting member 81*a* is preferably substantially identical to the second mounting member 81*b,* except that the first and second mounting members 81*a* and 81*b* are mirror images of each other. The first and second mounting members 81*a* and 81*b* are preferably each formed from a suitable rigid material, such as a lightweight metal. The first second mounting members 81*a* and 81*b* can be constructed of metal members that are first punched or stamped and then bent to form the shape shown in the drawings. Thus, the second mounting members 81*a* and 81*b* are each constructed as an integral, one-piece unitary member.

The first mounting member 81*a* basically includes an attachment portion 90*a* with a pair of side flanges 91*a* and 92*a.* The attachment plate or portion 90*a* has a hole 93*a* for receiving the fastener therethrough. This hole 93*a* can be threaded or unthreaded as needed and/or desired. The attachment portion 90*a* contacts the bottom surface of the base plate 40, while the side flanges 91*a* and 92*a* extend upwardly through openings in the base plate 40. The side flanges 91*a* and 92*a* extend substantially perpendicular to the attachment portion 90*a*. The side flange 91*a* only extends a part of the longitudinal length of the attachment portion 90*a*. The side flange 91*a* has an opening 94*a* therein. The side flange 92*a* has a pair of pivot openings 95*a* and 96*a* for receiving pivot pins 87*a* and 87*b,* respectively. Thus, the catch plate 83 and the latch plate 84 are pivotally mounted on the first mounting member 8l*a*. The first mounting member 8l*a* also includes a pair of arc-shaped control slots 96*a* and 97*a* for receiving the control pins 88*a* and 88*b,* respectively. An engagement slot 98*a* is vertically arranged within the side flange 92*a* such that it extends vertically with an open upper end for receiving the rear attachment pin 38. Finally, the side flange 92*a* also has an opening 99*a* at the intersection between the side flange 92*a* and the attachment portion 90*a*. The openings 94*a* and 99*a* do not serve any function in the first mounting member 81*a.*

Similar to the first mounting member 81*a,* the second mounting member 81*b* basically includes an attachment portion 90*b* with a pair of side flanges 91*b* and 92*b*. The attachment plate or portion 90*b* has a hole 93*b* for receiving the fastener therethrough. This hole 93*b* can be threaded or unthreaded as needed and/or desired. The attachment portion 90*b* contacts the bottom surface of the base plate 40, while the side flanges 91*b* and 92*b* extend upwardly through openings in the base plate 40. The side flanges 91*b* and 92*b* extend substantially perpendicular to the attachment portion 90*b.* The side flange 91*b* only extends a part of the longitudinal length of the attachment portion 90*b*. The side flange 91*b* has an opening 94*b* therein for receiving the control lever 86. The side flange 92*b* has a pair of pivot openings 95*b* and 96*b* for receiving pivot pins 87*a* and 87*b,* respectively. Thus, the catch plate 83 and the latch plate 84 are pivotally mounted on the first mounting member 81*b.* The first mounting member 81*a* also includes a pair of arc-shaped control slots 96*b* and 97*b* for receiving the control pins 88*a* and 88*b,* respectively. An engagement slot 98*b* is vertically arranged within the side flange 92*b* such that it extends vertically with an open upper end for receiving the rear attachment pin 38. Finally, the side flange 92*b* also has an opening 99*b* at the intersection between the side flange 92*b* and the attachment portion 90*b* to receive a portion of control lever 86 therein.

The spacers 82*a* and 82*b* axially separate the catch plate 83 and the latch plate 84 from the first and second mounting members 81*a* and 81*b* so that plates 83 and 84 can freely pivot on pivot pins 87*a* and 87*b.* More specifically, the spacer 82*a* is located between the first mounting member 81*a* and plates 83 and 84 such that catch plate 83 and latch plate 84 do not directly contact the first mounting member 81*a*. The spacer 82*a* can be constructed of any suitable material, preferably the spacer 82*a* is constructed of a material with a low coefficient of friction. For example, spacer 82*a* can be constructed of a smooth nylon material.

The spacer 82*a* has a pair of pivot openings 103*a* and 104*a,* a pair of clearance slots 105*a* and 106*a* and a vertical slot 107*a.* Openings 103*a* and 104*a* are sized to receive pivot pins 87*a* and 87*b,* while clearance slots 105*a* and 106*a* are designed to receive control pins 88*a* and 88*b.* The vertical slot 107*a* is designed to match with the engagement slot 98*a* of the mounting member 81*a* such that it does not interfere with the insertion or release of the rear attachment pin 38.

The spacer 82*b* has a pair of pivot openings 103*b* and 104*b,* a pair of clearance cut outs 105*b* and 106*b* and a vertical slot 107*b.* Openings 103*b* and 104*b* are sized to receive pivot pins 87*a* and 87*b,* while clearance cut outs 105*b* and 106*b* are designed to receive control pins 88*b* and 88*b.* The clearance cut out 106*b* is also designed to allow the control link 85 to freely pivot between the latch plate 84 and the side flange 92*b* of the second mounting member 81*b.* In other words, the thickness of spacer 82*b* is substantially equal to or slightly greater than the thickness of the control link 85, such that the control link 85 does not bind against either the second mounting member 81*b* or the latch plate 84 during its pivotal movement. The vertical slot 107*b* is designed to match with the engagement slot 98*b* of the mounting member 81*b* such that it does not interfere with the insertion or release of the rear attachment pin 38.

The catch plate 83 is pivotally mounted on first pivot pin 87*a* between first and second mounting members 81*a* and 81*b* and the spacers 82*a* and 82*b.* The catch plate 83 is normally biased in a clockwise direction as seen in the FIGS. 1–12 by biasing members 89*a* and 89*b,* which are connected between control pins 88*a* and 88*b.* More specifically, the catch plate 83 has a pivot hole 110 that receives pivot pin 87*a* and a control hole 112 that receives control pin 88*a.*

The catch plate 83 also has an attachment pin receiving recess 114 and three locking notches 115, 116 and 117. The recess 114 is designed to receive and hold the rear attachment pins 38 within the engagement slots 98*a* and 98*b* by rotation of the catch plate 83 in a direction opposite to the biasing forces of the biasing members 89*a* and 89*b.* More specifically, catch plate 83 cooperates with engagement slots 98*a* and 98*b* of the first and second mounting members 81*a* and 81*b* to lock the attachment pin 38 to the rear binding member 44. The notches 115, 116 and 117 hold the rear attachment pin 38 at various vertical heights within slots 98*a* and 98*b*. The notches 115, 116 and 117 selectively receive the latch plate 84 as discussed below to selectively obtain the three engagement positions.

Latch plate 84 is pivotally mounted on the first and second mounting members 81*a* and 81*b* via second pivot pin 87*b*. Latch plate 84 is normally biased in the counter-clockwise direction as seen in FIGS. 1–12 by the biasing members 89*a* and 89*b*. The latch plate 84 has a pivot hole 120 for receiving pivot pin 87*b*. The latch plate 84 also has a slot 122 for receiving the control pin 88*b*. Two teeth 124 and 126 are provided on the latch plate 84 for selectively engaging the notches 115, 116 and 117 of the catch plate 83. The biasing members 89*a* and 89*b* bias the latch plate 84 against the catch plate 83 such that the tooth 124 is located in one of the notches 115, 116 and 117. However, when the control lever 86 is rotated from a locking or engagement position to a release position, the latch plate 84 is moved in a clockwise direction about pivot pin 87*b*, such that the latch plate 84 is retracted away from the catch plate 83. This movement of the latch plate 84 by the control lever 86 allows the catch plate 83 to swing in a clockwise direction under the urging forces of biasing members 89*a* and 89*b*. The catch plate 83 can be stopped by the stopper tooth 126 to hold the catch plate 83 in its release position, as seen in FIG. 4. Alternatively, the clockwise movement of the catch plate 83 can be limited by the control pin 88*a* contacting the forward ends of the control slots 96*a* and 96*b* of the first and second mounting members 81*a* and 81*b*.

Movement of the latch plate 84 is controlled by control link 85 and control lever 86. Specifically, the control lever 86 is supported for pivotal movement on the side flanges 91*b* and 92*b* of the second mounting member 81*b*. The control link 85 has a bore 130 for receiving second control pin 88*b* therein, and a non-circular or square opening 132 for receiving one end of control lever 86 therein. Accordingly, rotation of the control lever 86 causes the control link 85 to pivot therewith, which in turn pulls the control pin 88*b* and the latch plate 84 in a forward direction away from the catch plate 83.

In the preferred embodiment, the control lever 86 has a hand portion 134 and a pivot portion 136, with the pivot portion having a free end 138 that has a non-circular cross-section. The free end 138 of the control lever 86 is secured within opening 132 of the control link 85. Accordingly, the pivot portion 136 of the control lever 86 is rotated by movement of the handle portion 134. This rotation of the pivot portion 136 causes the control link 85 to pivot about the axis of the pivot portion 136. Thus, the control link 85 pulls the control pin 88*b* in a forward direction, which in turn pulls the latch plate 84 away from the catch plate 83.

Pivot pins 87*a* and 87*b* are preferably headed pins with annular recesses at their free ends for receiving circlips or C-clips 140. Thus, the pivot pins 87*a* and 87*b* are fixedly coupled to the first and second mounting members 81*a* and 81*b*.

The control pins 88*a* and 88*b* are preferably pins with a substantially uniform circular cross-section, except for an annular recess located at each end. The recesses in the control pins 88*a* and 88*b* receive one end of the biasing members 89*a* and 89*b*. Accordingly, the pivot pins 88*a* and 88*b* are normally biased together such that the catch plate 83 and the latch plate 84 are also biased towards each other about the pivot pins 87*a* and 87*b*.

The biasing members 89*a* and 89*b* are preferably coil springs that are attached to the free ends of the first and second control pins 88*a* and 88*b*. It will be apparent to those skilled in the art from this disclosure that other types of arrangements can be utilized to accomplish the present invention. In other words, the present invention can be accomplished in a number of ways, and the present invention is not limited to the illustrated implementation.

The snowboard binding system 10, in accordance with the present invention, allows for the snowboard boot 20 to be attached to the snowboard binding 12 when the highback 46 is in its forward-most lean position. Specifically, the front and rear binding members 42 and 44 are arranged such that when the rider steps into the binding 12, the snowboard boot 20 moves rearwardly against the highback 46 during the engagement process. In other words, during engagement of the attachment member 14 to the binding 12, the upper portion of the snowboard boot 20 contacts the highback 48 such that the highback 48 flexes the upper portion of the snowboard boot 20 forward relative to the binding 12.

The front binding member 42 and the rear binding member 44 are spaced apart by a distance that corresponds to the spacing between the front and rear attachment pins 36 and 38, as will be apparent to those skilled in the art from this disclosure. In other words, the front attachment pin 36 should engage the stop surface 80*a* and the retaining surface 80*b* of the front binding member 42 when the rear attachment pin 38 is located within the engagement slots 98*a* and 98*b*, and recess 114 of catch plate 83. During the step-in motion, when the front attachment pin 36 engages the stop surface 80*a* of the front binding member 42, the rear attachment pin 38 is located over the slots 98*a* and 98*b* of the rear binding member 44. Then downward movement of the snowboard boot 20 causes the rear attachment pin 38 to move downwardly within the slots 98*a* and 98*b*. Also, the rear attachment pin 38 engages the front edge of the recess 114 to cause the catch plate 83 to rotate in a counterclockwise direction against the force of the biasing members 89*a* and 89*b*. The notches or teeth 115, 116 and 117 are designed as ratchets, such that the tooth 117 first rides along the upper surface of tooth 124 until tooth 124 engages the lowermost slot 115. Further downward movement of the boot 20 causes the catch plate 83 to further rotate in the counterclockwise direction about pivot pin 87*b* against the biasing forces of biasing members 89*a* and 89*b* until the tooth 124 engages the notch 116. Thus, the snowboard boot 20 with attachment member 14 is now coupled in the second engagement position. Further downward force of the snowboard boot 20 causes the rear attachment pin 38 to rotate the catch plate 83 about the pivot pin 87*a* against the biasing forces of biasing members 89*a* and 89*b* until the tooth 124 engages the third notch 117. In this position, the boot 20 with attachment member 14 is held in the third locking position.

Release of the catch plate is accomplished by moving handle portion 134 of control lever 86 downwardly such that control link 85 pulls control pin 88*b* and latch plate 84 in a forward direction. This forward movement of the latch plate 84 allows the catch plate 83 to rotate in a clockwise direction due to the biasing forces of the biasing members 89*a* and 89*b*. Thus, the attachment pin 38 can now be removed from the rear binding member 44.

Alternate Embodiments

Figure 13:
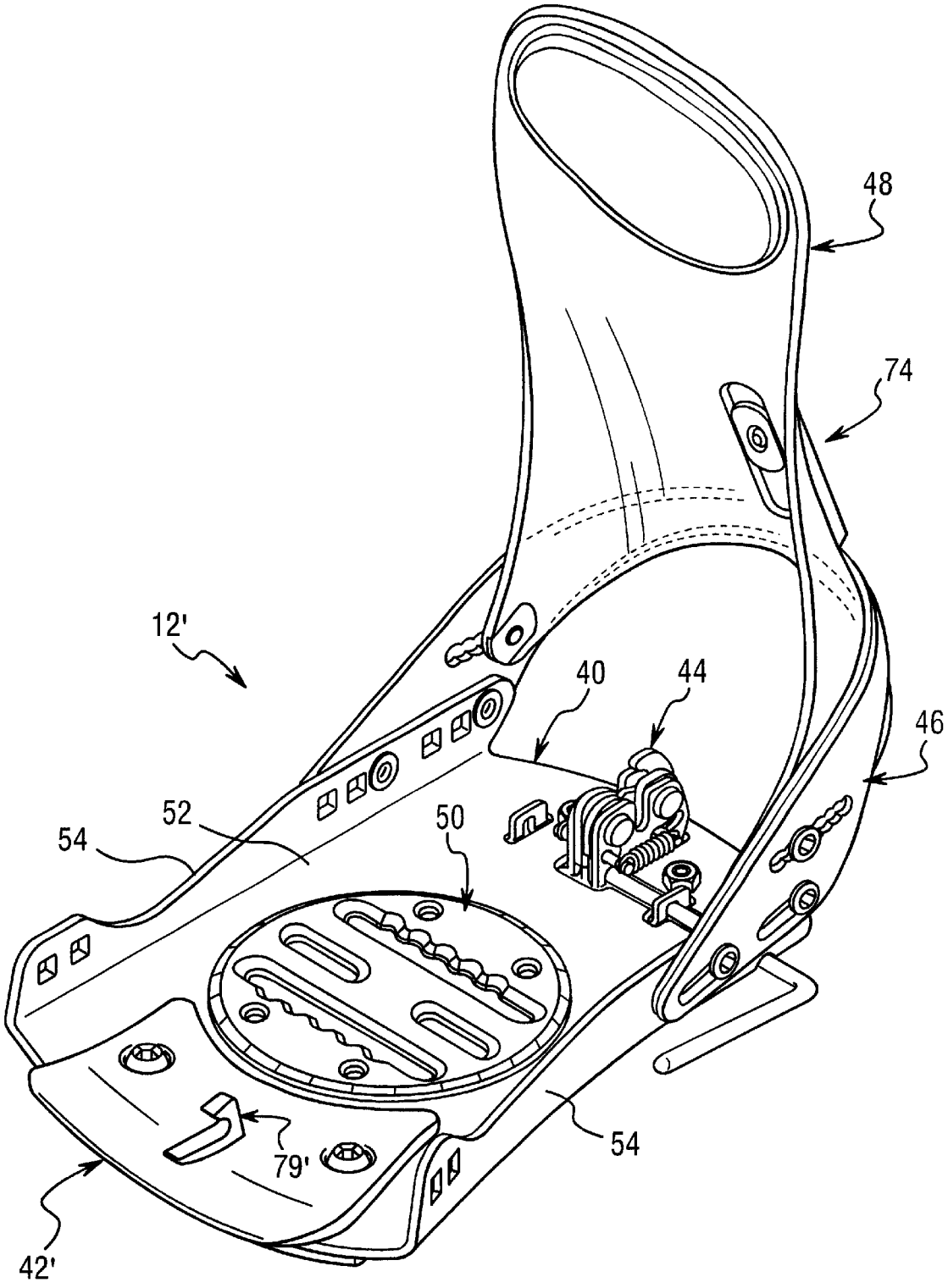
FIG. 13 is a perspective view of a snowboard binding illustrated in accordance with a second embodiment of the present invention.

Referring to FIG. 13, a snowboard binding 12' in accordance with another alternate embodiment of the present invention is illustrated. Basically, the binding 12' illustrated in FIG. 13 is identical to the binding 12 illustrated in FIGS. 1–12, except that an alternate front binding member 42' has been used. Specifically, the front binding member 42' has an open front engagement member 79'. In other words, the only difference between this embodiment and the first embodiment is that the guide portion 79*a* has been removed to give a longer arrange of longitudinal movement of the attachment member 14 relative to the binding 12'. In particular, the attachment slot of front engagement member 79' has an effective longitudinal length of about 10.0 millimeters to allow the boot 20 to flex forwardly during attachment of the boot 20 to the binding 12'.

In this embodiment of FIG. 13, the binding member 12' is attached to the attachment member 14 in the same manner as in the first embodiment, discussed above. In view of the similarities between the binding member 12' of this embodiment and the binding member 12 of the first embodiment, the binding member 12' of this embodiment will not be discussed or illustrated in detail herein. Moreover, identical reference numerals will be utilized to identify the parts in the second embodiment that are identical to the first embodiment. Also, the operation and descriptions of these identical parts will not be discussed or illustrated in detail herein.

Figure 14:
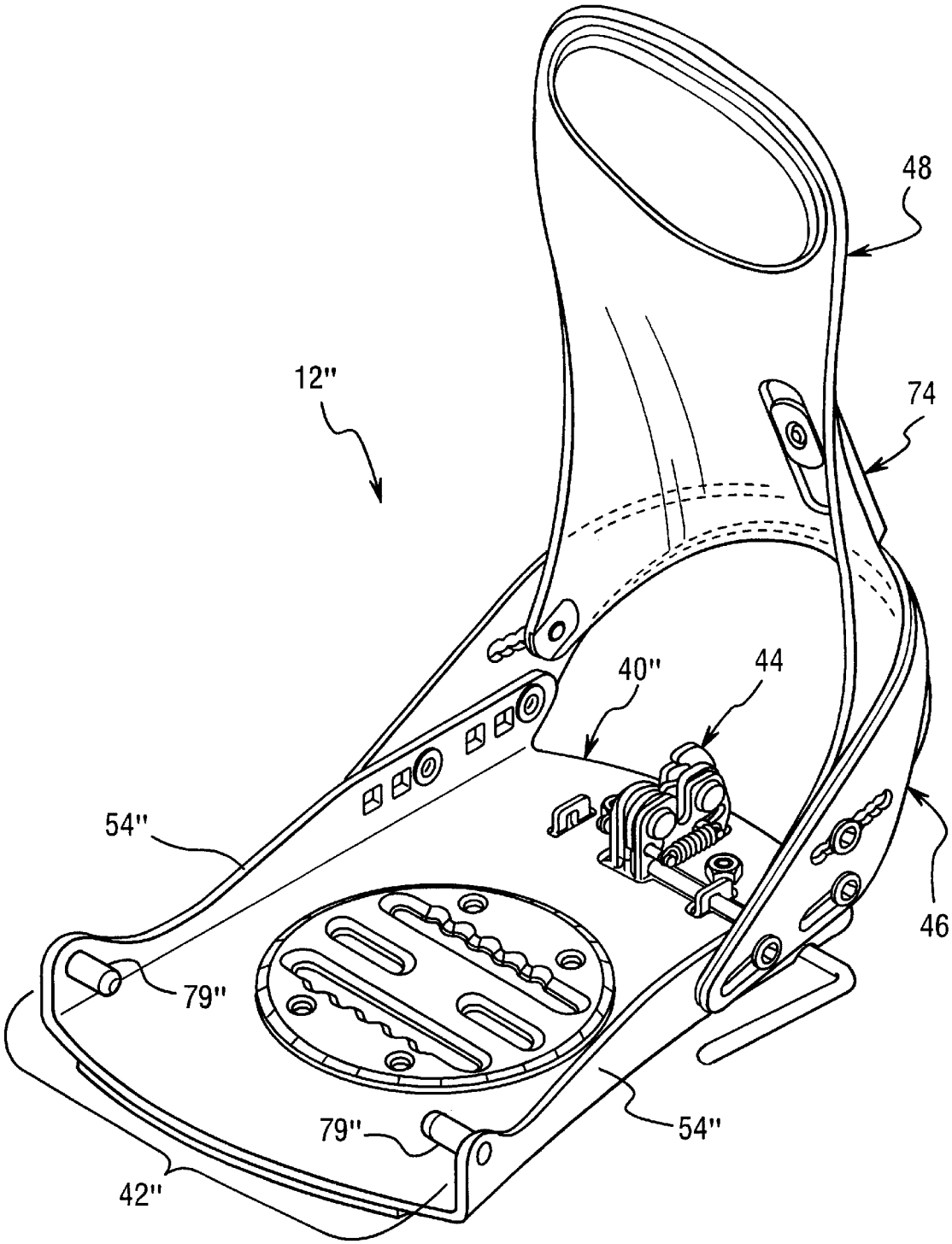
FIG. 14 is a perspective view of a snowboard binding in accordance with a third embodiment of the present invention.
Figure 15:
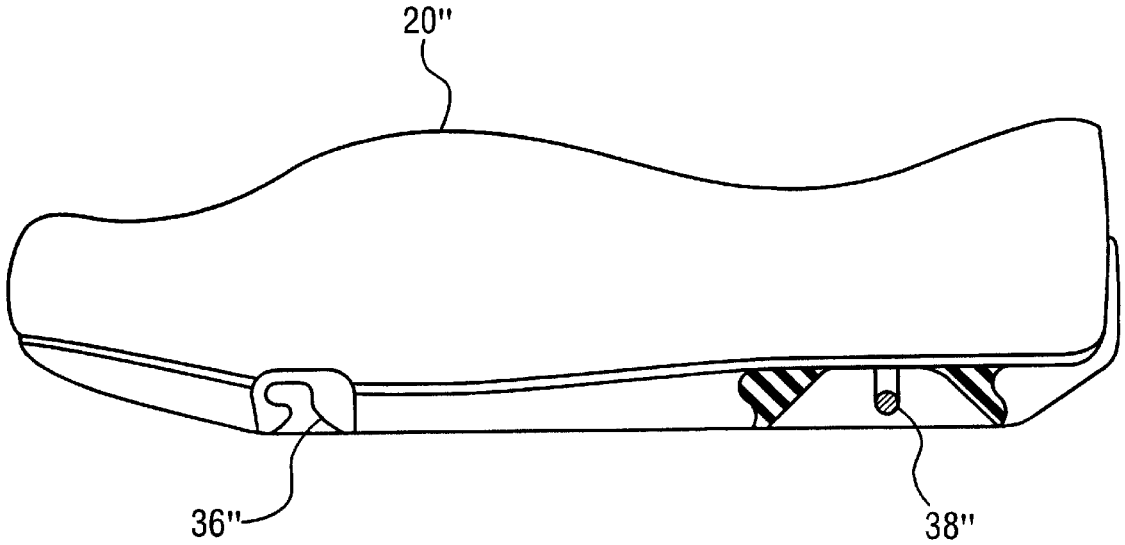
FIG. 15 is a side elevational view of a snowboard boot for use with the third embodiment of the present invention.
Figure 16:
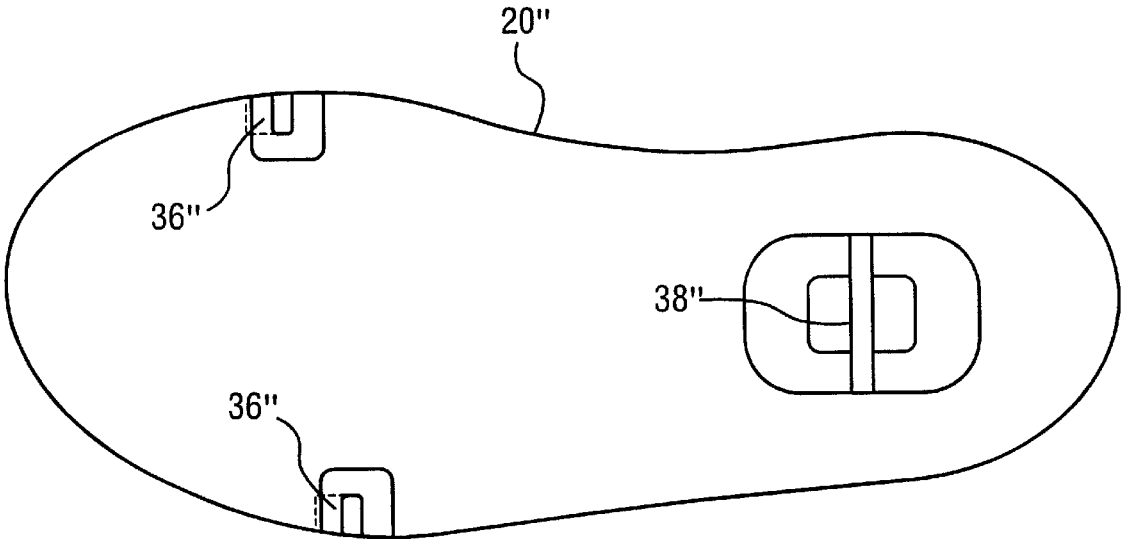
FIG. 16 is a bottom plan view of the snowboard boot illustrated in FIG. 15 for use with the snowboard boot binding illustrated in FIG. 14 in accordance with the third embodiment of the present invention.

Referring now to FIG. 14, a snowboard binding 12" in accordance with another alternate embodiment of the present invention is illustrated. Basically, the binding 12" illustrated in FIG. 14 is identical to the binding 12 illustrated in FIGS. 1–12, except that the base plate 40" has been modified to include an alternate front binding member 42". Specifically, the front binding 42" is formed by a pair of pins or engagement members 79" that are attached to the side attachments 54". Accordingly, in this embodiment of FIG. 14, a modified snowboard boot 20" is used as seen in FIGS. 15 and 16. Specifically, the attachment member of snowboard boot 20" is formed by a pair of recesses or attachment slots 36" and a single pin 38". The attachment slots 36" are formed in the front portion of the bottom sole of the snowboard boot 20" for engaging the of pins or engagement members 79". The pin 38" is attached to the rear portion of the sole of the snowboard boot 20" for engaging the rear binding member 44, which is the same as in the first embodiment. Other than the modification to the base plate 40" to include the front binding member 42", the binding 12" operates in the same manner as discussed above regarding the first embodiment of FIGS. 1–12. In view of the identical parts utilized in this embodiment and the first embodiment, identical parts will be given the same reference numerals. Moreover, the operation and descriptions of these identical parts will not be discussed or illustrated in detail herein.

Figure 17:
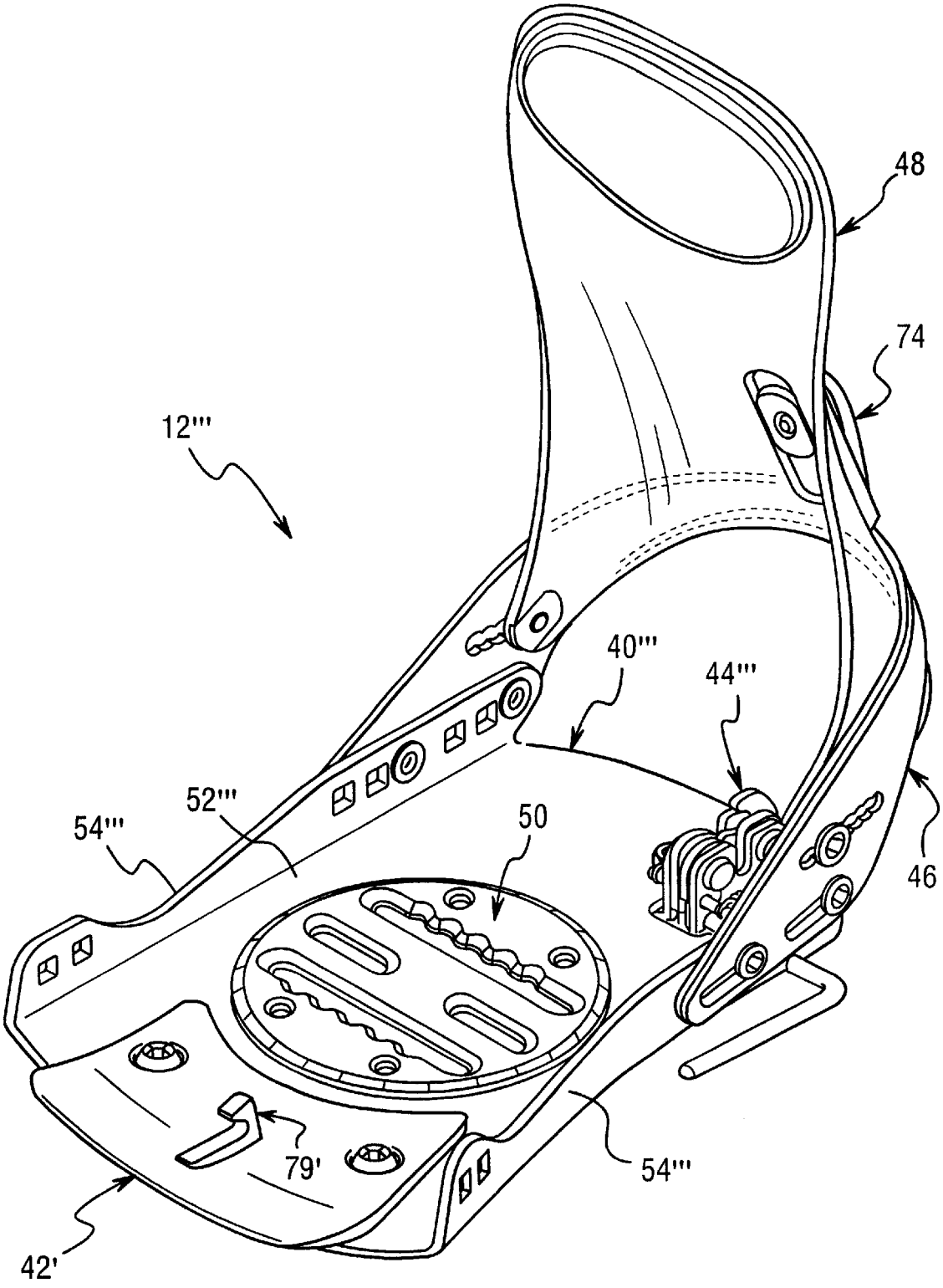
FIG. 17 is a perspective view of a snowboard boot binding in accordance with a fourth embodiment of the present invention.
Figure 18:
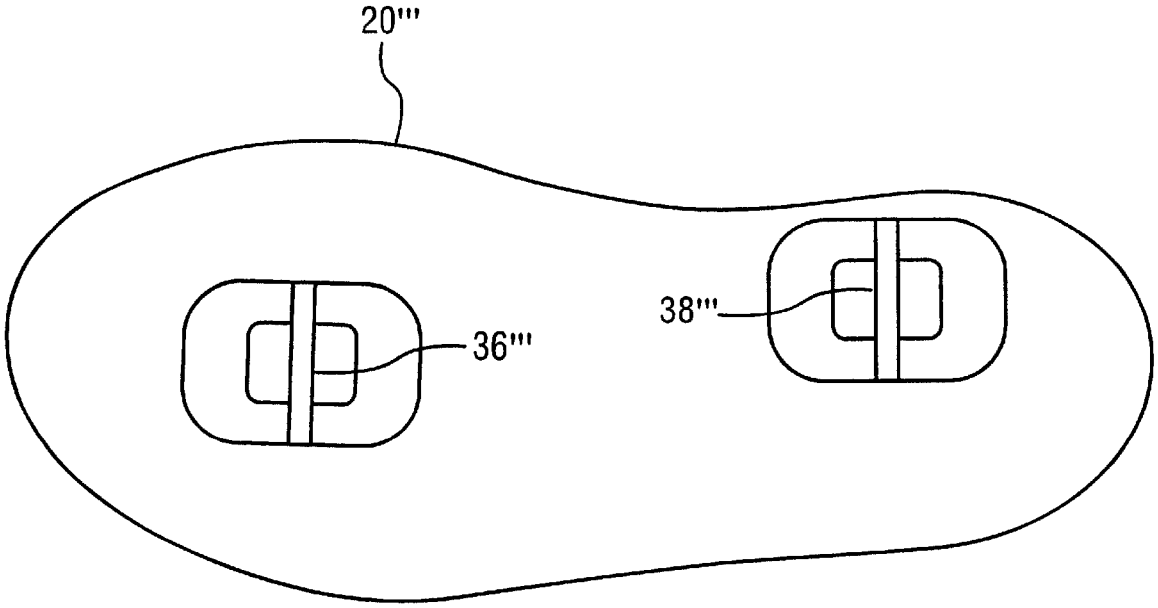
FIG. 18 is a bottom plan view of a snowboard boot for use with the snowboard binding illustrated in FIG. 17 in accordance with the fourth embodiment the present invention.

Referring now to FIGS. 17 and 18, a snowboard binding 12'" and a snowboard boot 20'" in accordance with another alternate embodiment of the present invention is illustrated. Basically, the binding 12' illustrated in FIG. 17 is identical to the binding 12 illustrated in FIGS. 1–12, except that the alternate front binding member 42' of FIG. 13 has been used, and the base plate 40" and the rear binding member 44'" has been modified to be offset to one of the sides to provide for more shock absorbing effect. The rear binding member 44'" operates in the same way as the rear binding member 44, which is discussed above. In view of the similarities between this embodiment and the prior embodiments, this embodiment will not be discussed or illustrated in detail herein. Moreover, identical reference numerals will be utilized to identify the parts in the second embodiment that are identical to the first embodiment. Regarding the snowboard 20'", the attachment pins 36'" and 38'" are separately mounted to the sole portion of the snowboard boot 20'" as seen in FIG. 18.

Figure 19:
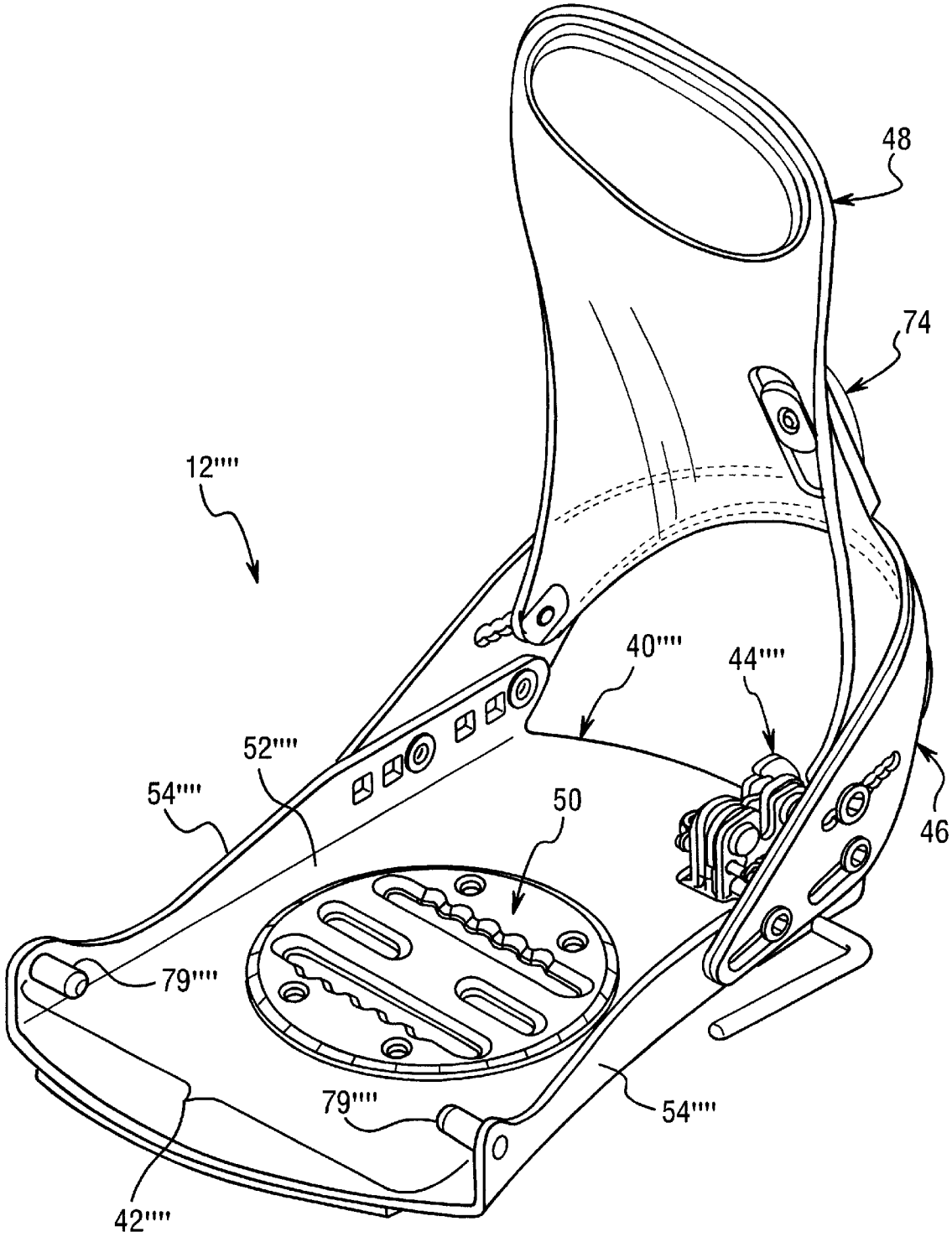
FIG. 19 is a perspective view of a snowboard boot binding in accordance with a fifth embodiment of the present invention.
Figure 20:
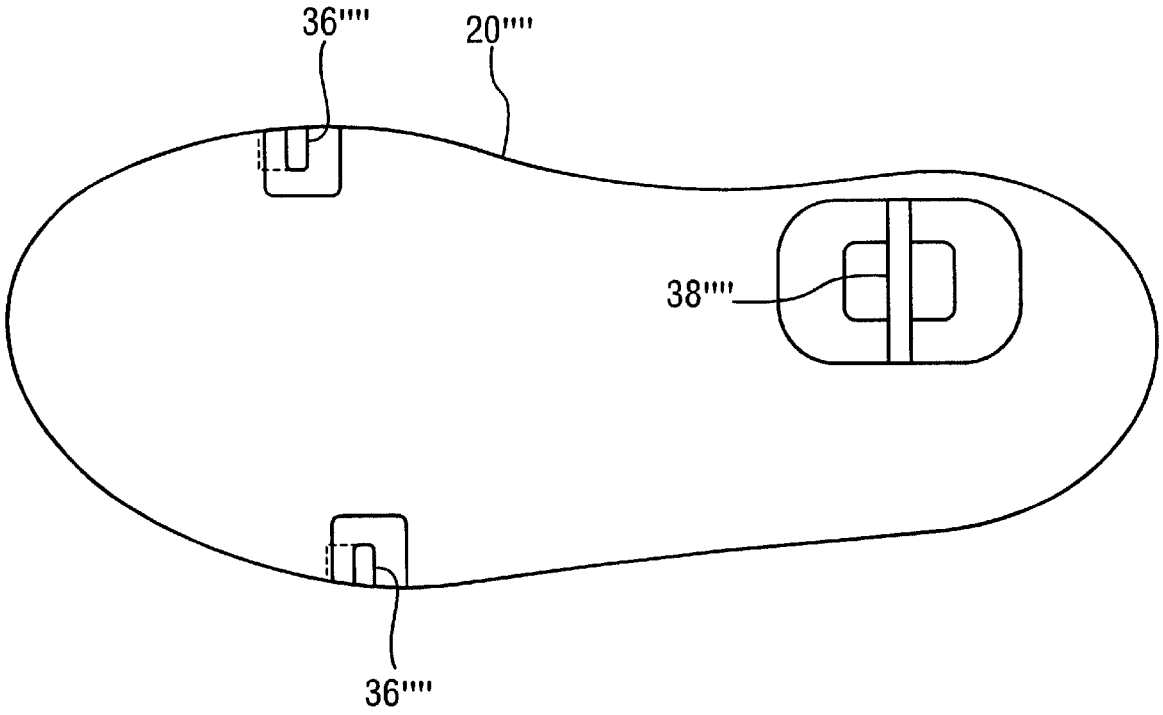
FIG. 20 is a bottom plan view of a snowboard boot for use with the snowboard boot binding illustrated in FIG. 19 in accordance with the fifth embodiment of the present invention.

Referring now to FIGS. 19 and 20 a snowboard binding 12"" and a snowboard boot 20"" in accordance with another alternate embodiment of the present invention is illustrated. Specifically, the binding 12"" is a highbred of the embodiments illustrated in FIGS. 14 and 17, while the sole of the snowboard boot 20"" is a highbred of the embodiments illustrated in FIGS. 16 and 18. The rear binding member 44"" operates in the same way as the rear binding member 44, which is discussed above. In view of the similarities between this embodiment and the prior embodiments, this embodiment will not be discussed or illustrated in detail herein. Moreover, identical reference numerals will be utilized to identify the parts in the second embodiment that are identical to the first embodiment. Regarding the snowboard 20"", the attachment member of snowboard boot 20"" is formed by a pair of recesses or attachment slots 36"" and a single pin 38"". The attachment slots 36"" are formed in the front portion of the bottom sole of the snowboard boot 20"" for engaging the of pins or engagement members 79"". The pin 38"" is attached to the rear portion of the sole of the snowboard boot 20"" for engaging the rear binding member 44"", which operates in the same manner as in the first embodiment.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A snowboard binding, comprising:

a base plate having a front portion, a rear portion and a longitudinal axis extending between said front and rear portions;

a first binding member coupled to said base plate for selectively securing one end of a snowboard boot to said base plate; and a second binding member coupled to said base plate at a location that is longitudinally spaced from said first binding member and positioned to selectively receive a pin member located on a bottom surface of a snowboard boot, said second binding member including a catch member movable relative to said base plate and a latch member movable relative to said base plate, said latch member arranged to selectively hold said catch member in a plurality of engagement positions having different heights above said base plate said catch member having a recess configured to receive said pin member, said pin member being positioned between said catch member and said latch member when said catch member is in at least one of said plurality of engagement positions.

2. A snowboard binding according to claim 1, wherein said first binding member coupled to said front portion of said base plate, and said second binding member coupled to said rear portion of said base plate.

3. A snowboard binding according to claim 1, wherein said first binding member includes a longitudinally arranged attachment slot.

4. A snowboard binding according to claim 3, wherein said attachment slot has a longitudinal length of at least about 6.6 millimeters.

5. A snowboard binding according to claim 3, wherein said first binding member includes a guide portion with an inclined guide surface located at a front location of said attachment slot relative to said base plate.

6. A snowboard binding according to claim 1, wherein said base plate includes an opening and an adjustment disk being located within said opening of said base plate for selective rotation of said base plate about said adjustment disk.

7. A snowboard binding according to claim 1, wherein said base plate includes an inclined highback support extending upwardly and forwardly relative to said rear portion of said base plate.

8. A snowboard binding according to claim 1, wherein said catch member is a catch plate pivotally supported about a first pivot axis, and said latch member is a latch plate pivotally supported about a second pivot axis.

9. A snowboard binding according to claim 8, wherein said first and second pivot axes are arranged substantially perpendicular to said longitudinal axis of said base plate.

10. A snowboard binding according to claim 9, wherein said latch plate and said catch plate are biased in opposite directions about said first and second pivot axes, respectively.

11. A snowboard binding according to claim 10, wherein said latch plate includes a control lever operatively coupled thereto to move said latch plate out of engagement with said catch plate.

12. A snowboard binding according to claim 11, wherein said latch plate and said catch plate are coupled together by at least one biasing member that is arranged to bias said latch plate and said catch plate in said opposite directions about said first and second pivot axes, respectively.

13. A snowboard binding according to claim 11, wherein said second binding member includes a substantially vertically arranged engagement slot with an open upper end that is selectively closed by said catch plate.

14. A snowboard binding according to claim 1, wherein said first binding member includes at least one pin having its axis substantially perpendicular to said longitudinal axis of said base plate.

15. A snowboard binding according to claim 1, wherein said first binding member includes a pair of pin having their axes arranged substantially perpendicular to said longitudinal axis of said base plate.

16. A snowboard binding system, comprising:

a snowboard boot having a sole portion with a first pin, member and a second pin member located at longitudinally spaced areas on a bottom surface of said sole portion;

a base plate having a front portion, a rear portion and a longitudinal axis extending between said front and rear portions;

a first binding member coupled to said base plate to selectively receive said first pin member; and a second binding member coupled to said base plate at a location that is longitudinally spaced from said first binding member and positioned to selectively receive said second pin member located on said bottom surface of said sole portion of said snowboard boot, said second binding member including a catch member movable relative to said base plate and a latch member movable relative to said base plate said catch member having a recess configured to receive said second pin member, said latch member arranged to selectively hold said catch member in a plurality of engagement positions having different heights above said base plate, said second pin member being positioned between said catch member and said latch member when said catch member is in at least one of said plurality of engagement positions.

17. A snowboard binding system according to claim 16, wherein said first binding member coupled to said front portion of said base plate, and said second binding member coupled to said rear portion of said base plate.

18. A snowboard binding system according to claim 16, wherein said first binding member includes a longitudinally arranged attachment slot.

19. A snowboard binding system according to claim 18, wherein said attachment slot has a longitudinal length of at least about 6.6 millimeters.

20. A snowboard binding system according to claim 18, wherein said first binding member includes a guide portion with an inclined guide surface located at a front location of said attachment slot relative to said base plate.

21. A snowboard binding system according to claim 16, wherein said base plate includes an opening and an adjustment disk being located within said opening of said base plate for selective rotation of said base plate about said adjustment disk.

22. A snowboard binding system according to claim 16, wherein said base plate includes an inclined highback support extending upwardly and forwardly relative to said rear portion of said base plate.

23. A snowboard binding system according to claim 16, wherein said catch member is a catch plate pivotally supported about a first pivot axis, and said latch member is a latch plate pivotally supported about a second pivot axis.

24. A snowboard binding system according to claim 23, wherein said first and second pivot axes are arranged substantially perpendicular to said longitudinal axis of said base plate.

25. A snowboard binding system according to claim 24, wherein said latch plate and said catch plate are biased in opposite directions about said first and second pivot axes, respectively.

26. A snowboard binding system according to claim 25, wherein said latch plate includes a control lever operatively coupled thereto to move said latch plate out of engagement with said catch plate.

27. A snowboard binding system according to claim 26, wherein said latch plate and said catch plate are coupled together by at least one biasing member that is arranged to bias said latch plate and said catch plate in said opposite directions about said first and second pivot axes, respectively.

28. A snowboard binding system according to claim 26, wherein said second binding member includes a substantially vertically arranged engagement slot with an open upper end that is selectively closed by said catch plate.

29. A snowboard binding system according to claim 16, wherein said first binding member includes at least one pin having its axis substantially perpendicular to said longitudinal axis of said base plate.

30. A snowboard binding system according to claim 16, wherein said first binding member includes a pair of pins having their axes arranged substantially perpendicular to said longitudinal axis of said base plate.

* * * * *